US005145200A

United States Patent [19]

Humphrey

[11] Patent Number: 5,145,200

[45] Date of Patent: Sep. 8, 1992

[54] UNIVERSAL INTEGRAL SKI CONTROL SYSTEM

[75] Inventor: John M. Humphrey, Monte Sereno, Calif.

[73] Assignee: Humphrey Engineering, Inc., Monte Sereno, Calif.

[21] Appl. No.: 459,464

[22] Filed: Jan. 2, 1990

[51] Int. Cl.[5] ..... A63C 7/10

[52] U.S. Cl. ..... 280/605; 188/5

[58] Field of Search ..... 280/601, 604, 605, 608, 280/809, 606; 188/5, 6, 7, 8

[56] References Cited

U.S. PATENT DOCUMENTS

| | | | |
|---|---|---|---|
| 3,048,418 | 8/1962 | Gertsch | 280/605 |
| 3,195,911 | 7/1965 | Cubberley | 280/605 |
| 3,295,859 | 1/1967 | Perry | 280/601 |
| 3,873,108 | 3/1975 | Lacarrau et al. | 280/605 |
| 3,909,024 | 9/1975 | Salomon | 280/605 |
| 3,918,730 | 11/1975 | Schultes | 280/605 |
| 3,980,322 | 9/1976 | Schultz | 280/605 |
| 4,062,561 | 12/1977 | Altenburger | 280/605 |
| 4,103,916 | 8/1978 | Krob et al. | 280/605 |
| 4,152,007 | 5/1979 | Smith | 280/605 |
| 4,219,214 | 8/1980 | Kostev | 250/605 |
| 4,227,708 | 10/1980 | Lote | 280/809 |
| 4,227,714 | 10/1980 | Riedel | 280/605 |
| 4,312,517 | 1/1982 | Spademan | 280/605 |
| 4,795,183 | 1/1989 | Reuters | 280/605 |

FOREIGN PATENT DOCUMENTS

| | | |
|---|---|---|
| 14420 | 8/1903 | Austria . |
| 650475 | 3/1936 | Fed. Rep. of Germany . |
| 3543829 | 6/1987 | Fed. Rep. of Germany . |
| 736916 | 12/1913 | France . |
| 816949 | 5/1937 | France . |
| 433183 | 4/1948 | Italy . |
| 187456 | 11/1936 | Switzerland . |

*Primary Examiner*—Charles A. Marmor
*Assistant Examiner*—Richard Camby
*Attorney, Agent, or Firm*—John J. Leavitt

[57] ABSTRACT

Presented is a universal integral ski control system including a base member on which is mounted a drag control probe assembly including probes that are selectively displaceable between a retracted position and an extended position in which the control probes extend past the running surface of the ski so as to project into the snow on opposite sides of the ski when the skis are in use. The probe assembly is manipulable by the skier for selectively effecting displacement of the drag control probes into either a retracted position or extended position. The base is universally applicable in that it may be integrally incorporated into a ski boot and thus be available for use when the ski boots are donned and the skier steps into the ski bindings, or it may be incorporated integrally into the toe piece assembly of the bindings, or under the toe piece, or incorporated integrally into the ski itself.

20 Claims, 3 Drawing Sheets

UNIVERSAL INTEGRAL SKI CONTROL SYSTEM

BACKGROUND OF THE INVENTION

1. Field of the Invention

This invention relates to ski control devices and systems, and particularly to a universal ski control system applicable to the skis, ski bindings, and ski boots of all manufacturers, and effective to enhance the skier's ability to control speed and maneuverability on a downhill skiing run. This invention is related to the inventions disclosed in applications Ser. Nos. 07/126,211 now ABND and 07/318,738 now U.S. Pat. No. 4,911,461 filed by the inventor herein.

2. Description of the Prior Art

A search of the prior art has revealed the existence of the following Uunited States patents:

| | | |
|---|---|---|
| 3,980,322 | 3,918,730 | 3,909,024 |
| 3,195,911 | 3,048,418 | 4,152,007 |
| 4,103,916 | 4,062,561 | 4,227,708 |
| 3,873,108 | 4,312,517 | 4,227,714 |

In addition to the patents listed above, the following United States patents were cited in application Ser. No. 07/318,738:

| | | |
|---|---|---|
| 3,295,859 | 4,219,214 | 4,795,183 |

Foreign patents cited in applications Ser. Nos. 07/318,738 and 07/126,211 include the following:

French patents 736,916 and 816,949;

Austian patent 14,420;

Switzerland patent 187,456;

Italian patent 433,183; and

German patents 650,475 and 3,543,829

Close examination of the prior art listed above indicates that most of the structures disclosed in these patents relate to crampon type devices that facilitate cross-country skiing in that the the structures enable climbing a snow-covered hill with a minimum of back-sliding. These crampon type devices are not intended for, nor are they capable of controlling the speed and maneuverablility of downhill skis on a downhill run merely through execution of conventional body movements. Others of these patents relate to ski brakes effective only after a skier falls off the the skis, functioning to stop the loose ski from continuing down the snowy slope.

It is important to understand that the structure forming the subject matter of this invention does not concern the problem of stopping a loose ski that has become separated from a skier, nor does this invention relate to cross-country type skis equipped with special cross-country type bindings that do not permit the transfer of torque forces to the skis and crampon type devices to prevent back-sliding when climbing a slope, or to brake devices intended primarily to bring the skier to a halt. Rather, this invention focuses on the problem of imposing additional controlling forces on the skis while actively being used in a downhill skiing activity or "run" in such a way that the skier will still proceed downhill but will feel more in control of the skis at the speed at which the skier chooses to descend.

Referring to the patents listed above, all of the United States patents except U.S. Pat. Nos. 3,295,859; 4,152,007 and 4,227,708 relate to the situation where a ski has been separated from a skier and is loose on the ski slope and apt to cause some damage or injury to skiers unless stopped. These "loose ski" brake devices do not operate during active skiing, and are clearly unrelated to the structure and function of the invention described herein.

U.S. Pat. No. 3,295,859 merely discloses parallel longitudinal grooves or channels formed in the running surface of the ski adjacent to, but inboard of each side edge, to provide pronounced V-shaped edges. These function merely like sharper edges, applying load along the entire length of the ski rather than as local control probes applying loads at a specific location along the ski.

U.S. Pat. No. 4,152,007 provides snow plows at the rear ends of the skis that are activated by hydraulic pressure controlled through the grips on the ski poles. Obviously, there must be some connection between the grips on the ski poles and the snow plows and this in itself is a disadvantage in that the skier is prevented from utilizing the ski poles as freely as he might for the purpose for which they are intended. This device provides active drag, which is the only function it shares with my invention described herein. The characteristics of this device are in sharp contrast with the enhanced control and maneuverability provided by my invention. Because the plows in this device are at the rear ends of the skis and therefore far behind the center of pressure on the skis, they actually tend to prevent the skier from turning while they are engaged. The hydraulic actuation is also significantly different than the normal skiing motions that are effective to control the maneuverability characteristics of skis equipped with my invention. Therefore, this device is clearly functionally and structurally different from my method and apparatus.

U.S. Pat. No. 4,227,708 relates to a ski brake that comprises a plate fixed on the upper surface of the ski. The plate is provided with a notch into which the lower end of the ski pole may be inserted to produce drag against the snow. While the primary purpose of this device is to provide traction in cross-country skiing, it purports to provide active braking for a cross-country skier moving downhill. Active braking is also one of the at least three important functions of my apparatus. However, this device does not provide either the enhanced maneuverability or control of the skis by natural body motions provided by my apparatus. Maneuverability is an essential difference between downhill skiing and cross-country skiing. The bindings of cross-country skis naturally limit maneuverability. Since this device applies drag only on the outside of the skis, downhill braking would tend to spread the tips of the skis, making the skis even more difficult to maneuver. Use of the ski poles as braking levers violates the natural motions of downhill skiing which requires upper body movement and free use of the poles. Therefore, this device, while obviously structurally different from my apparatus in all its embodiments, is also clearly incapable of performing two of at least three major functions performed by my skis incorporating integral probe assemblies.

Referring to the foreign patents listed above, Austrian Patent 14,420 appears to be a crampon type device to be used by cross-country skiers when "walking" up slopes and the need arises to prevent back-sliding of the skis.

French Patent 816,949 discloses the concept of a brake for downhill skiing, but the brake mechanisms of at least two of the embodiments require a harness to be worn by the skier, with a tether extending between the harness and the brake mechanism. In these embodiments, the brake mechanism is activated by a "loaded" spring when the skier squats, and is deactivated by tension on the tether to again load the spring when the skier straightens up. In a third embodiment, the brake mechanism is normally deactivated by a loaded spring, and activated by the skier depressing the mechanism with a ski pole against the deactivating force exerted by the spring. This patent also discloses two different types of crampon devices useful for climbing slopes without back-sliding. This device, located behind the skier's center of gravity and the center of pressure of the skis, only purports to be useful for straight ski braking and does not provide the enhanced downhill ski maneuvering capability of the instant invention.

German Patent 650,475, Italian Patent 433,183 and Switzerland Patent 187,456 appear to be directed solely to crampon type devices useful for climbing snow-laden slopes as in cross-country skiing. None of the structures illustrated and described by these patents appears useful for controlling speed and maneuverability in downhill skiing.

German Patent 3,543,829 discloses a brake device which requires activation by continuous engagement of a ski pole so long as the brake is applied. The ski poles may thus not be used for their intended purpose while being used to activate the brake. Disengagement of the ski pole from the activating lever of the brake mechanism appears to automatically deactivate the brake. This device does not address the use of localized forces near the skier's center of gravity or the center of pressure of the skis to achieve enhanced maneuverability by creating a torque about the center of pressure of the ski.

Lastly, French Patent 736,916 discloses the use of paddles on opposite sides of a ski that function automatically as crampon devices to prevent back-sliding in a cross-country climb of a snow-laden slope. The paddles may also be controlled by tension imposed on cables connected at their lower ends to the gear-reduction mechanism that actuates the paddles, and grasped at their opposite ends in each hand of the skier. The skier is thus enabled to make cross-country-like turns by braking more on one ski than the other, causing the braked ski to drag behind the other ski, thus facilitating a turn. For speed control this device requires continuous paddle depth control by the skier using cables which, of course, is most difficult if not impossible to achieve. Additionally, this device does not provide the bindings to impose sufficient torque about the ski centerline as a means of providing enhanced maneuverability because cross-country type ski bindings in use at the time of this invention, and even to the present, are not designed to support such torque applied to the skis through the bindings. It is thus clear that the structure and function of this braking mechanism is not intended for nor can it be operated to enhance lateral maneuverability of skis in the sport of downhill skiing as it is known today.

Accordingly, one of the objects of the present invention is the provision of a significant improvement in the integral ski control system and structure disclosed in application Ser. No. 07/318,738 so as to provide selectivity of the axial location of the control probes in relation to the center of pressure of the skis, which is also near the vertical projection of the skier's center of mass on the skis for most skiing maneuvers.

Another object of the invention is the provision of a ski control system designed to enable substitution of probes of different configurations to achieve varying lift-to-drag ratios from the probes in a downhill skiing run.

A still further object of the invention is the provision of a universal integral ski control system that may be incorporated into the sole of a ski boot, or incorporated into and underneath the toe piece, or incorporated on any ski as an add-on or retrofit device sandwiched between the toe piece and the top surface of the ski.

Still another object of the invention is the provision of a ski control system for downhill skis that may be incorporated directly onto the ski while providing the advantages of selectivity of the axial location of the probes in relation to the center of pressure on the skis and the vertical projection of the skier's mass, and selectivity regarding the configuration of the probes to provide varying lift-to-drag ratios thereof.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the universal integral ski control system of the invention comprises a quadrilateral base member on which is mounted a drag control probe assembly including probes that are selectively displaceable between a retracted position and an extended position in which the control probes extend past the running surface of the ski so as to project into the snow on opposite sides of the ski when the skis are in use. Means are provided manipulable by the skier for selectively effecting displacement of the drag control probes into either a retracted position or extended position. The base is universally applicable in that it may be integrally incorporated into a ski boot and thus available for use when the ski boots are donned and the skier steps into the ski bindings, or it may be incorporated integrally into the toe piece assembly of the bindings, or under the toe piece, or incorporated integrally into the ski itself.

DESCRIPTION OF THE PREFERRED EMBODIMENT

Figure 1:
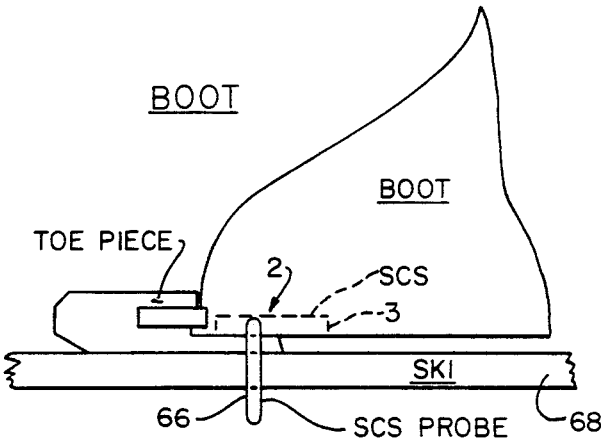
FIG. 1 is a diagrammatic view illustrating the invention incorporated into a ski boot.
Figure 2:
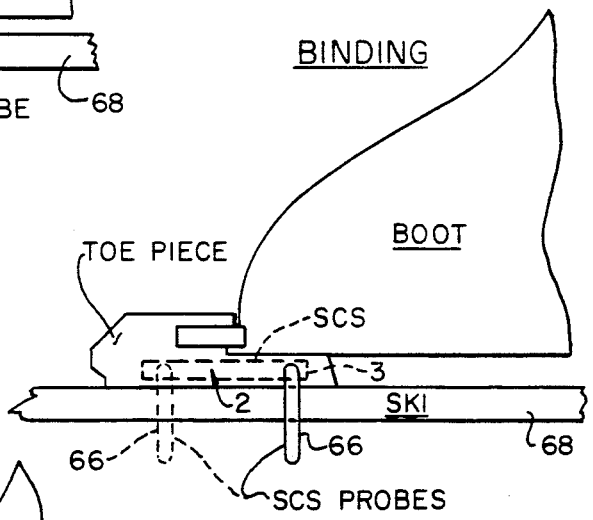
FIG. 2 is a diagrammatic view illustrating the invention incorporated into the toe piece of ski bindings.
Figure 3:
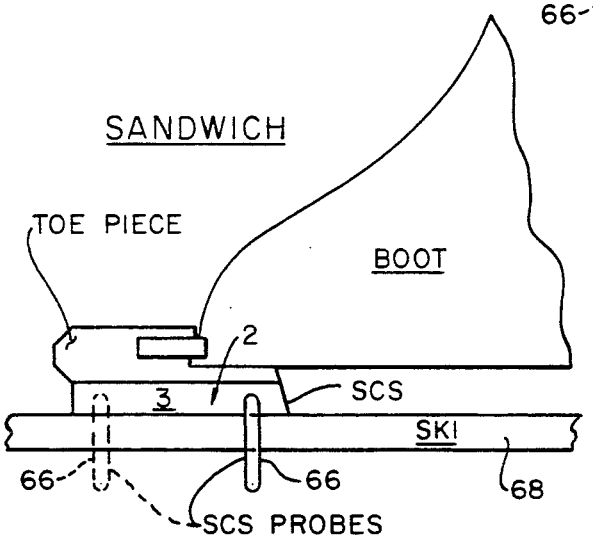
FIG. 3 is a diagrammatic view illustrating the invention sandwiched between the toe piece and the top surface of a ski.
Figure 4:
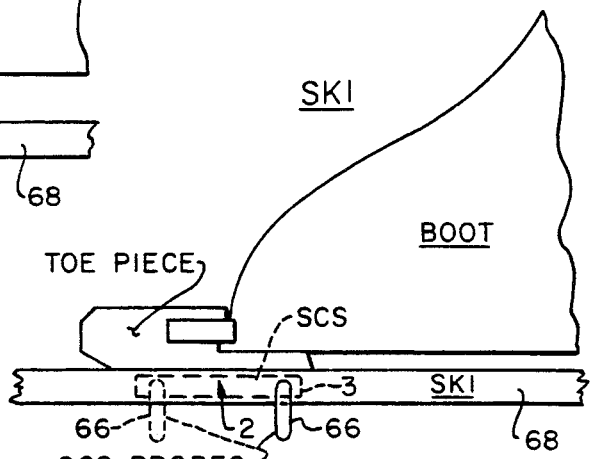
FIG. 4 is a diagrammatic view illustrating the invention integrally incorporated into the structure of a ski.

In terms of greater detail, and referring to the embodiment of the invention illustrated in FIGS. 5 through 8, the universal integral ski control system is designated generally by the numeral 2, and comprises a generally quadrilateral base member 3, conveniently rectangular as shown and formed from a synthetic resinous material such as that sold under the brand name "Delrin". Obviously, other materials, such as metal, could also be used. The rectangular base is thus provided with a top surface 4, a bottom surface 6, an aft end edge 7, a front end edge 8 and lateral side edges 9 and 12. Preferably, the base has a thickness of about ⅝" but other thicknesses could be used.

Figure 5:
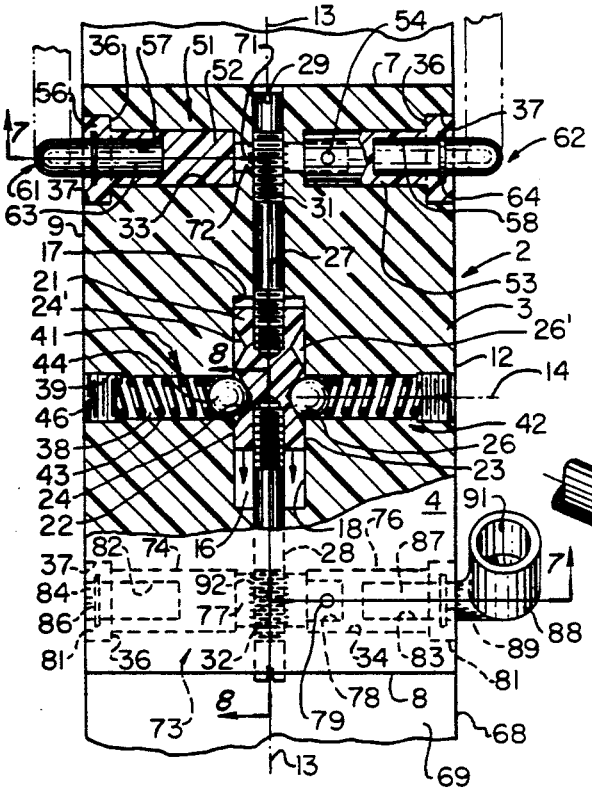
FIG. 5 is a plan view of the preferred embodiment of the invention, portions of the structure being broken away to reveal the underlying parts.

As viewed in FIG. 5, the base is symmetrical with respect to a central longitudinal axis 13, and is symmetrical also with respect to a transverse medianly positioned axis 14. At the intersection of the axes 13 and 14, or stated in other words, centrally disposed in the base, the top surface 4 of the base is provided with a rectangular recess 16 the long dimension of which is arranged along the longitudinal axis on both sides of the lateral axis and the lateral side walls 17 and 18 being parallel to one another and to the side edges 9 and 12, respectively, of the base, and equally spaced on opposite sides of the longitudinal axis. It should be noted that the depth of the recess is such that it does not penetrate through the full thickness of the base, the recess thus having a floor 19 for a purpose which will become apparent hereinafter.

Figure 6:
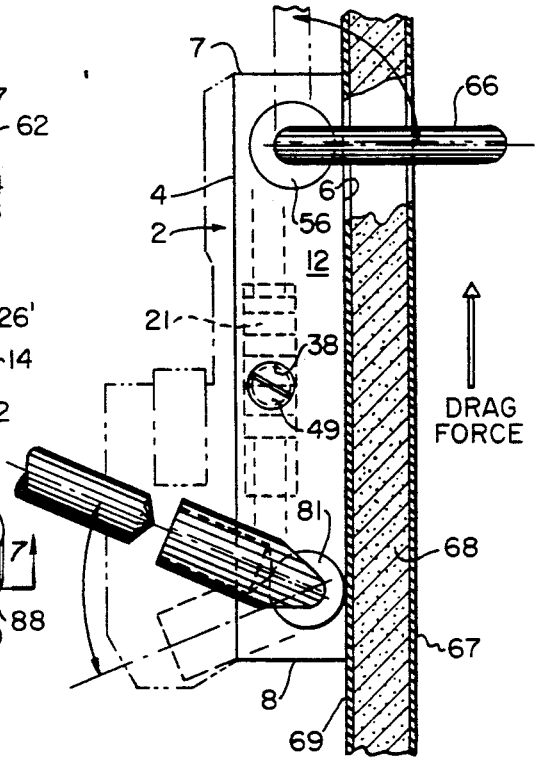
FIG. 6 is a side elevational view of the embodiment of the invention illustrated in FIG. 5, shown mounted on a ski, with portions of the ski broken away to shorten the view.
Figure 8:
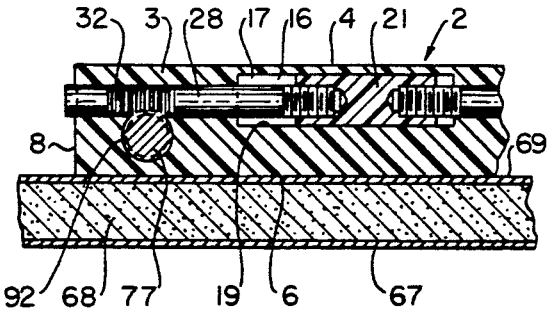
FIG. 8 is a fragmentary vertical cross-sectional view taken in the plane indicated by the line 8—8 in FIG. 5.
Figure 9:
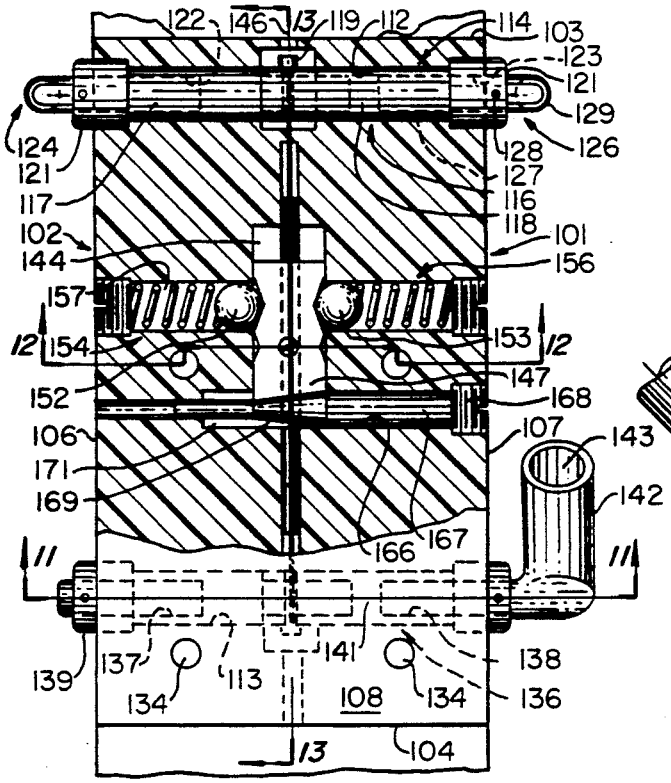
FIG. 9 is a plan view of a second embodiment of the invention, portions of the structure being broken away to reveal underlying parts.
Figure 10:
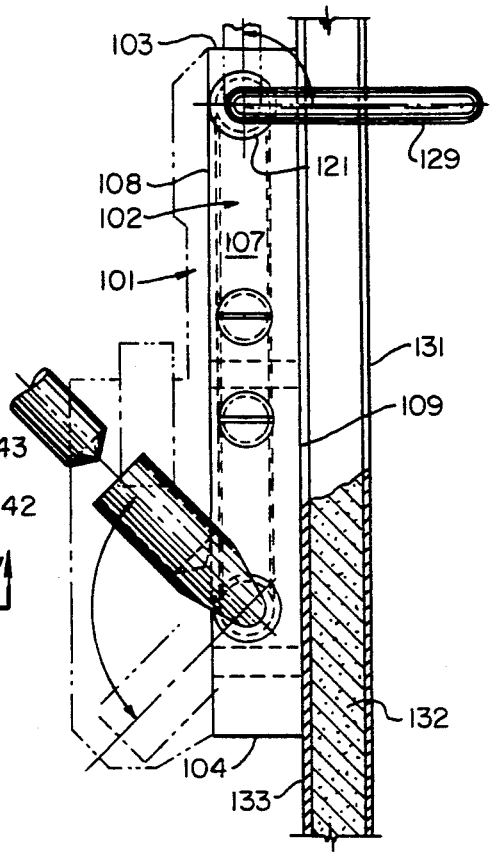
FIG. 10 is a side elevational view of the embodiment of the invention illustrated in FIG. 9, shown mounted on a ski, with portions of the ski broken away to shorten the view.
Figure 11:
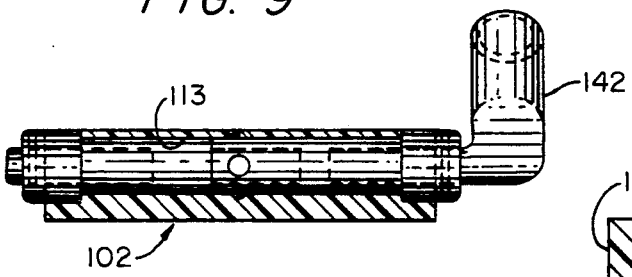
FIG. 11 is a vertical cross-sectional view taken in the plane indicated by the line 11—11 in FIG. 9.
Figure 12:
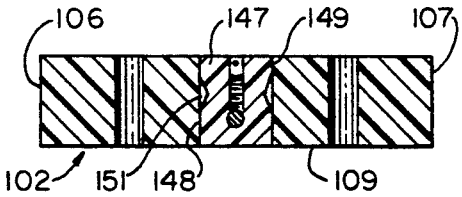
FIG. 12 is vertical cross-sectional view taken in the plane indicated by the line 12—12 in FIG. 9.
Figure 13:
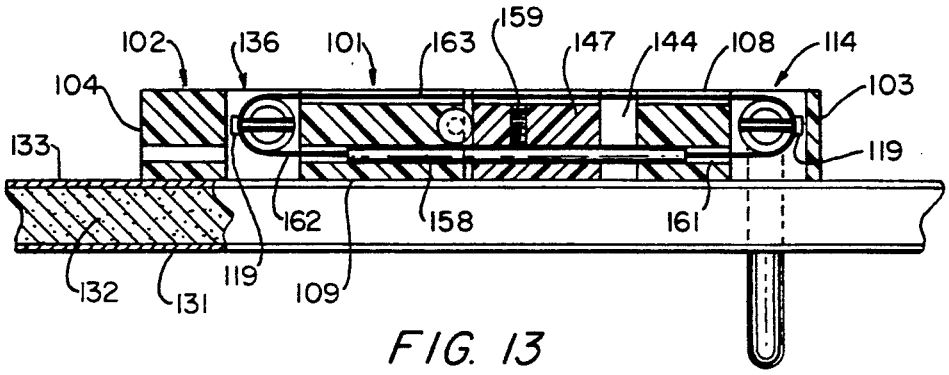
FIG. 13 is a vertical cross-sectional view taken in the plane indicated by the line 13—13 in FIG. 9.

As illustrated in FIGS. 5, 6 and 8, the recess 16 is adapted to slidably receive a detent block 21 the lateral sides 22 and 23 of which are formed with conical detent recesses 24 and 24' associated with the lateral side 22, and conical detent recesses 26 and 26' associated with the lateral side 23 of the detent block. For reasons which will be explained hereinafter, the conical detent recesses 24 and 26 possess a depth greater than the conical detent recesses 24' and 26'. Extending longitudinally and rotatably through appropriate bores through the base from opposite end edges 7 and 8, are a pair of mutually reaching axially aligned force transmitting and adjustment shafts 27 and 28, respectively, each rotatably accommodated in an appropriate bore formed in the base as shown and communicating with the interior of the central recess 16. The shafts 27 and 28 are threaded at their associated ends and threadably engage complementary threaded bores formed in opposite ends of the slidable detent block 21 as shown in FIG. 5. At their opposite ends, the shafts are provided with screwdriver slots 29 by which each may be individually adjusted longitudinally in relation to the slidable detent block to which each is threadably engaged.

The force transmitting and adjustment shafts 27 and 28 are provided intermediate their ends with threaded sections 31 and 32, respectively, each of the threaded sections constituting a "rack" operatively associated with a rotatable "pinion" as will hereinafter be explained.

Adjacent its opposite end edges 7 and 8, the base plate is provided with transverse bores 33 and 34, respectively, of uniform diameter, each of the bores extending the full width of the base and intercepting opposed side edges 9 and 12 as shown in FIG. 5. The bores are parallel to each other and to the associated end edges 7 and 8 and each is symmetrical about a central axis that lies below a median plane parallel to the top and bottom surfaces 4 and 6 so that the axis of each of the bores lies closer to the lower surface 6 than to the upper surface 4 for reasons which will appear. At each end associated with the side edges 9 and 12, each bore 33 and 34 is rabetted to provide shoulders 36 forming the bottoms of recesses 37 constituting larger diameter extensions of the bores 33 and 34 and coaxially aligned therewith.

Approximately midway between the bores 33 and 34, and parallel thereto, there is provided a third transversely extending bore 38 of uniform diameter that intercepts the side edges 9 and 12 as shown in FIG. 5. The bore 38 also intercepts the side walls 17 and 18 of the central recess 16. Stated in other words, the side walls 17 and 18 of the central recess 16 interrupt the continuity of the bore 38, each portion of the bore 38 on opposite sides of the longitudinal center line of the base opening into the recess 16. The other end portions of the bore 38 adjacent the side edges 9 and 12 are provided with threads 39 as shown.

Referring to FIG. 5, there is rotatably mounted in the transversely extending interrupted bore 38 a pair of spring-pressed detent ball assemblies designated generally by the numerals 41 and 42. The spring-pressed detent ball assembly 41 includes compression spring 43 impinging on detent ball 44 at its inner end and impinging against cap 46 at its opposite end. The end cap is threaded to complement the threads 39, and the end cap may be threadably adjusted to increase or decrease the resilient spring force exerted against the detent ball 44. As shown, the detent ball 44 rests in conical detent recess 24 and presses resiliently against the conical sides of the detent recess, thus tending to retain the slide block 21 in the position shown. In like manner, the detent ball assembly 42 includes a compression spring 47 impinging on detent ball 48 and on cap 49, and may be adjusted to control the amount of resilient spring pressure exerted on detent ball 48 which rests in conical detent recess 26. The two opposed spring-pressed detent assemblies thus impose equal and opposite forces on the slide block 21, tending to retain it in the position shown, and requiring a significant amount of pressure to dislodge the slide block from its position. It should be understood that while the opposed detent assemblies 41 and 42 tend to retain the slide block 21 in the position shown, it is movable longitudinally of the base member, as will hereinafter be explained, so that the detent recesses 24' and 26' are brought into registry with the detent balls. As previously explained, the detent recesses 24' and 26' are of lesser depth than the detent recesses 24 and 25, and it therefore requires the application of more force on the slide block 21 to displace it from the position shown than it does to displace it from a position in which the detent balls engage the detent recesses 24' and 26'. The direction of movement of the slide block to achieve its alternate position when the detent balls engage the more shallow detent recesses 24' and 26' is indicated in FIG. 5 by the directional arrows. While I have shown only two sets of detent recesses 24/26 and 24'/26', it should be understood that additional detent recesses may be provided, and additional spring-pressed detent assemblies may also be provided to cooperate therewith.

Again referring to FIG. 5, there is provided adjacent the aft end edge 7, and rotatably mounted in the transverse bore 33 of the base member, a drag control probe assembly designated generally by the numeral 51, and including first and second axially aligned telescoping rotatable shaft members 52 and 53 secured together at their inner telescoped ends by an appropriate roll pin or set screw 54 to retain the two telescoped members against relative longitudinal and rotational displacement. The shaft members 52 and 53 are provided with enlarged bearing flanges 56 that rest snugly and rotatably in the recesses 37 at each end of the bore 33.

Additionally, the outer end portions of the rotatable shaft members 52 and 53 are provided with counterbores 57 and 58, respectively, that selectively detachably receive identical drag control probe members designated generally by the numerals 61 and 62, each drag control probe member including a stub shaft portion 63, a bayonet-connector flange 64 adapted to detachably engage a complementary socket in the associated bearing flange 56, and including also a depending drag probe 66 integral with the stub shaft portion 63 and perpendicular thereto. The drag probe 66 is illustrated as being cylindrical, about ¼" in diameter, and of sufficient length to project below the lower "running" surface 67 of a ski 68 to the top skier support surface 69 of which the base member is attached in such manner that the drag control probe assembly is positioned longitudinally of the ski on or about the center of pressure of the ski, or on or about the projection of the skier's mass in relation to the ski.

Figure 7:
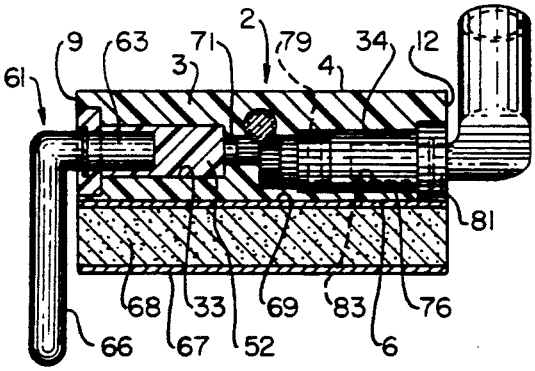
FIG. 7 is a vertical cross-sectional view taken in the plane indicated by the line 7—7 in FIG. 5.

As illustrated in FIGS. 5, 6 and 7, the probes 66 are shown fully extended so that when the ski rests on the snow, the probes project into the snow about ¼". Means are provided to selectively retract the probes from their extended position shown or, when in retracted position, to selectively extend the probes for re-engagement with the snow. Such means includes a reduced-in-diameter section 71 formed on the first drag control shaft member 52, an end portion of which is telescoped within a complementary bore in the second drag control shaft member 53. Formed on the outer periphery of the reduced-in-diameter section of the shaft member 52 are a series of teeth or threads 72 complementary to and engaging the threads 31 formed on the force transmitting member 27. It will thus be seen that axial translation of the force transmitting member effects controlled rotation of the drag control probe assembly 51 and the probes 66.

It should also be understood that micrometer-type adjustment of the probes 66 may also be accomplished by rotating the force transmitting member 27 in relation to the slide block 21, which is held captive against rotation by the recess in which it is slidably mounted, and resiliently retained against longitudinal displacement by the effect of the detent balls 44 and 48 which are fully engaged in the detent recesses 24 and 26. Such micrometer-type adjustment of the probes 66 enables setting the probes at an angle other than 90° so that they are canted rearwardly, thus decreasing their depth of penetration by virtue of their angulation in relation to the lower surface of the ski. This micrometer-type adjustment may conveniently be made by use of a screwdriver or coin inserted into the slot 29 in the outer end of the shaft 27.

To effectively impose an axial translation force on the force transmitting member 27 of such magnitude and extent as to result in repositioning of the drag probes 66 from an extended position to a retracted position, or from a retracted position to an extended position, there is provided a drag probe skier-actuated assembly designated generally by the numeral 73. The actuation assembly 73, as illustrated in FIGS. 5, 6 and 7 is rotatably journaled in the transverse bore 34 adjacent the front end edge 8 of the base member. The actuation assembly comprises a two-part shaft including first and second shaft parts 74 and 76, respectively, the shaft part 74 having a reduced diameter portion 77 that slidably telescopas into a complementary bore 78 formed in the end of the second shaft part 76 as shown. A roll pin or set screw 79 retains the two shaft parts against relative axial or rotational displacement. Bearing flanges 81 formed on the remote ends of the two shaft parts 74 and 76, cooperate with the set screw 79 to retain the actuation assembly rotatably mounted in the base member. The shaft parts 74 and 76 are also provided with counterbores 82 and 83 in their ends associated with the bearing flanges. The counterbore 82 receives a detachable plug member 84 secured to the associated shaft part 74 by the same type of bayonet-connector flange 86 described above in connection with the drag probe 66. The counterbore 83 receives the shank or stub shaft 87 of a ski pole receiving socket member 88 secured in the associated end of the shaft part 76 by a bayonet-connector flange 39, and having a recess 91 into which the lower end of a ski pole may be inserted to impose a rotative moment on the socket member to thus effectively rotate the actuation assembly.

The reduced diameter section 77 of the actuation assembly is provided with teeth of threads 92 operatively engaging the complementary teeth or threads 32 formed in the shaft 28 so that when the actuation assembly is rotated by a rotative moment being applied to the socket member 88 the shaft 28 is thrust either forward of back, depending on the direction in which the actuation assembly is rotated. From the position illustrated in FIGS. 5 and 6, a counterclockwise rotation of the actuation assembly as viewed in FIG. 6 will result in the drag probes 66 being displaced from an extended position to a retracted position. Concomitantly, the detent block 21 will shift forwardly so that the detent balls become engaged in the detent recesses 24' and 26'. The drag probes will remain in this position until the actuation mechanism is again manipulated, this time being rotated in a clockwise direction to re-extend the drag probes into the position illustrated in the drawings.

It will thus be seen that the skier has instant and very effective control of the position and of the effect of the drag probes. It should also be understood that if the skier inadvertently encounters a rock buried in the snow that strikes one or both drag probes, the force of the impact is resiliently absorbed by the detent block 21 which will be shifted in its position to retract the probe, thus preventing damage to the probe assembly.

The detent mechanism provides automatic load limiting or load damping. The drag force acting on the probes depends on the probe configuration, depth of penetration of the snow, speed and the characteristics of the snow. When the drag force reaches a preset limit determined by the resilient pressure exerted on the detent block by the spring-pressed detent balls, the detent block 21 begins to move toward a probe-retracted position which allows the probes to partially rotate out of the snow. This rotation reduces the depth of penetration of the snow and therefore the drag force until it equals the detent limit, thus stopping further rotation. If the drag force decreases, the probes will rotate back into the snow until a new equilibrium is reached or the probes reach their fully engaged position as determined by positions of shafts 27 and 28. The ability of the probes to rapidly and automatically adjust position to limit the drag load frees the skier from drag load control duties and promotes a smooth ride.

The embodiment of the invention illustrated in FIGS. 9 through 13 is very similar to the preferred embodiment illustrated in FIGS. 5 through 8. Accordingly, in the interest of brevity in this description, this description will emphasize the differences in the two embodiments. Thus, referring to FIGS. 9, 10 and 11, it will be seen that there is provided a ski control system designated generally by the numeral 101, and including a base member designated generally by the numeral 102, conveniently formed from "Delrin" but also susceptible of being fabricated from other materials such as metal and other synthetic resinous materials. The base member 102 is preferably rectangular in configuration, having an aft end edge 103, a front edge 104, right side edge 106 considering the direction of motion of a ski on which the system is mounted as indicated by the arrows, left side edge 107, top surface 108 and bottom surface 109.

Adjacent the end edges 103 and 104, the base member is provided with bores 112 and 113, respectively, extending transversely through the base member from side edge to side edge. The transverse bore 112 rotatably receives a drag control probe assembly designated generally by the numeral 114, journaled in the bore and comprised of a two-part shaft 116 including a first shaft part 117 extending into the bore from the right side edge, and a second shaft part 118 extending into the bore from the left side edge of the base member. An inner end portion of the first shaft part is reduced in diameter as shown in the drawings, and the inner end portion of the second shaft part is counterbored to snugly receive the reduced diameter end portion of the first shaft part, also as shown in the drawings. A set screw 119 locks the two shaft parts together and prevents relative rotational and axial displacement thereof. The ends of the shaft parts associated with the side edges are enlarged to provide bearing and mounting flanges 121 seated snugly and rotatably in recesses formed in the side edges, thus cooperating with the set screw to prevent axial displacement of the drag control probe assembly in relation to the base member. It should be noted however that the bearing and mounting flanges extend outboard of the side edges with which they are associated by a small amount rather than being flush with the side edges as in the embodiment of FIG. 5. The outer end portions of the shaft parts 117 and 118 are provided with counterbores 122 and 123, respectively, and there are mounted in the counterbores drag probe assemblies designated generally by the numerals 124 and 126, respectively. Each drag probe comprises a shank portion 127 snugly received in the associated counterbore and secured therein in a detachable non-rotatable manner by a set screw 128. Integral with the outer end of each shank portion is a perpendicular drag probe 129 proportioned in length to project below the "running" surface 131 of a ski 132 to the upper skier support surface 133 of which the universal integral ski control system is detachably secured, as by appropriate screws 134.

Thus, while I have illustrated drag probes having a cylindrical configuration of about ¼" diameter, it should be understood that other configurations designed to produce special effects under predetermined conditions may be substituted for the drag probes shown merely by loosening the set screws, removing the drag probes illustrated and substituting others having a different configuration. For instance, in a high speed slalom, it may be desireable to be equipped with probes that impose little drag on a straight run downhill, but which impose considerable drag to resist lateral sliding of the skis in a fast turn, or on icy snow, and to impose a turning moment on the skis to enable execution of a sharper turn around a pylon.

The transverse bore 113 adjacent the front end edge 104 rotatably receives a two-part shaft structure 136 similar in construction to the shaft structure 116. Counterbore 137 in this embodiment receive a filler plug 139 at the end of the shaft adjacent the right side edge 106, and counterbore 138 receives the shank 141 of a socket member 142 having a recess 143 for accepting the end of a ski pole to selectively rotate the probe actuation assembly and through it the drag probe assemblies.

To effectively transfer rotation of the probe actuation shaft assembly 136 to corresponding rotation of the two-part shaft 114 on the ends of which the probe assemblies 124 and 126 are detachably mounted, there is provided in the top surface 108 of the base member a recess 144 generally aligned with the longitudinal center line 146 of the base member and slidably receiving a detent block 147. The detent block is provided with lateral surfaces 148 and 149 in which are formed conical detent recesses 151 spaced along the length of the detent block and adapted to receive therein detent balls 152 and 153 forming a part of the spring-pressed detent assemblies 154 and 156, respectively, which are received in a transverse bore 157 that intercepts the side walls of the recess 144. These assemblies are generally identical to the corresponding assemblies illustrated and described in connection with FIG. 5 and that description is included hereat by reference.

Mounted in the lower portion of the detent block is an elongated mounting rod 158, secured to the detent block by a set screw 159, and adapted to slide back and forth within an appropriate bore 161 formed longitudinally in the base member as shown. Connected to opposite ends of the mounting rod is the lower reach 162 of an endless cable which is wound about the rotatable shaft assemblies 114 and 136 and then continues in an upper reach 163 that extends generally parallel to the longitudinal center line of the base member as shown. To retain the cable taut between the two rotatable shaft assemblies and to eliminate the possibility of slippage, the cable is wrapped once or twice about the shanks of the set screws 119. It will thus be seen that rotation of the probe actuation shaft assembly 136 in either direction effects rotation of the drag probe mounting shaft 114 in a corresponding direction, with corresponding displacement of the drag probes between retracted or extended position. It should be noted that in this embodiment, when the ski pole is inserted into the socket 142 to displace the drag probes from a deployed position to a retracted position, the ski pole must be pushed forwardly in the same manner as in the embodiment of the invention illustrated in FIG. 5. However, in this embodiment, such forward displacement of the ski pole causes the lower reach of the cable to move rearwardly, carrying the detent block rearwardly to reset the detent balls in the more shallow detent recesses. Thus in this embodiment, while the detent assembly performs the same function as the corresponding assembly of FIG. 5, the detent slide block moves in the opposite direction.

Added to this embodiment is a fourth transverse bore 166 disposed in the base member between the bore 38 that contains the spring-pressed detent assemblies and the probe actuation control shaft 136. Mounted in this bore is an elongated pin 167 having threads 168 on one outer end portion adapted to threadably engage complementary threads in the bore as shown, and thus permit axial translation of the pin in relation to the base member. Intermediate the ends of the pin there is provided a conical ramp 169 which generally lies in a portion 171 of the bore 166 that opens into the central recess 144 so that the ramp in effect constitutes the end wall of the recess against which the detent block normally impinges when the drag probes are extended. Since axial translation of the pin shifts the ramp in relation to the recess in which the detent block is slidably disposed, it will be seen that a variable limit of travel may be imposed on the detent slide block. As shown in the drawings, such limit of travel of the detent slide block may be selected to restrict deployment of the drag probes to less than their full 90° maximum penetration position by screwing the pin inwardly.

It will thus be seen that with either of the two embodiments described herein, even expert skiers may benefit from equipping their skis with my ski control system to facilitate control of the skis through the use of conventional body movements on a downhill ski run. Novice skiers or less than expert skiers also benefit because my ski control system enables a skier to control the "comfort level" at which the skier participates in the sport of downhill skiing. Added advantages for all skiers of every level of competence is provided by the versatility of the system that enables control probes of one configuration to be detached and substituted with other control probes of a different configuration to produce a different control affect.

With my system described and illustrated herein, not only may different probe configurations be substituted to achieve special affects, but the location of the probes in relation to the center of pressure of the skis may also be modified. Thus, under special circumstances, it may be desirable to mount two probes on the outboard side of the skis instead of just one. Or probes that penetrate to different depths in the snow may be located in relation to the center of pressure of the skis to provide a special result when conventional body movements are utilized in a downhill run. Additionally, the implementation of my universal integral ski control system is versatile in that it may be incorporated in the different ways illustrated in FIGS. 1 through 4 of the drawings.

Having thus described the invention, what is believed to be new and novel and sought to be protected by letters patent of the United States is as follows.

I claim:

1. As an article of manufacture, a universal integral ski control system for application to the skier support surface of a downhill snow ski having a "running" surface adapted to slide over the snow in a downhill run, comprising:

a) a base member adapted to be mounted on the skier support surface of a downhill snow ski and having right and left side edges correlated to the right and left side edges of the downhill snow ski when mounted thereon;

b) a drag probe assembly operatively mounted on said base member and including right and left side drag probes correlated to the right and left side edges of said base member and resiliently retained and selectively displaceable between a retracted position in which said drag probes are resiliently retained to not project below the running surface of the ski on which said base member is mounted to an extended position in which said drag probes are resiliently retained to project below the running surface of the ski on which said base member is mounted so that when said ski is in use in a downhill run said drag probes extend into the snow supporting the ski so as to impose both a drag force and a rotational torque on said ski so that the drag force and torque may be separately controlled by the skier through execution of natural and conventional body movements; and c) drag probe assembly actuation and automatic resilient retention means mounted on the base member operatively connected to said drag probe assembly and selectively initially actuable by a skier to shift said drag probes between retracted or extended positions and thereafter automatically shiftable toward a probe retracted equilibrium position when the drag force imposed on the drag probes increases and approaches the resilient retention force, and are automatically shiftable toward a fully extended equilibrium position when the drag force imposed on the drag probes is reduced below the resilient retention force imposed on the drag probes.

2. The universal integral ski control system according to claim 1, in which said base member is provided with an aft end edge and a front end edge, said drag probe assembly is mounted on said base member adjacent said aft end edge, said drag probe assembly actuation and automatic resilient retention means includes an actuator shaft mounted on said base member adjacent said front end edge, and means operatively interconnecting said drag probe assembly actuation and automatic resilient retention means with said drag probe assembly so that selective actuation of said actuator shaft by a skier effects selective displacement of said drag probes between retracted or extended positions.

3. The universal integral ski control system according to claim 1, in which said drag probes assembly includes at least one selectively rotatable shaft extending transversely across said base member between said right and left side edges, and said right and left drag probes are detachably mounted on opposite ends of said rotatable shaft for rotation therewith and including drag probe portions disposed at right angles to said rotatable shaft.

4. The universal integral ski control system according to claim 1, in which said base member includes an aft end edge, a transverse bore extending through said base member adjacent said aft end edge between said right and left side edges, and said drag probe assembly includes a shaft selectively rotatably journalled in said transverse bore by selective actuation of said drag probe assembly actuation and automatic resilient retention means.

5. The universal integral ski control system according to claim 1, in which means are provided interconnecting said drag probe assembly with said drag probe assembly actuation and automatic resilient retention means so that selective actuation of said drag probe assembly actuation and automatic resilient retention means results in actuation of said drag probe assembly to displace said drag probes into either a retracted position or an extended position in which they are releasably retained by a resilient retention force.

6. The universal integral ski control system according to claim 2, in which said means operatively interconnecting said drag probe assembly actuation and automatic resilient retention means with said drag probe assembly includes a force transmitting member mounted on the base member and extending longitudinally thereof and connected to said drag probe assembly actuation means and said drag probe assembly whereby actuation of the drag probe assembly by drag forces imposed thereon or actuation of the drag probe assembly actuation means by a skier effects actuation of the other.

7. As an article of manufacture, a universal integral ski control system for application to the skier support surface of a downhill snow ski having a "running" surface adapted to slide over the snow in a downhill run, comprising:

a) a base member adapted to be mounted on the skier support surface of a downhill snow ski and having right and left side edges correlated to the right and left side edges of the downhill snow ski when mounted thereon;

b) a drag probe assembly operatively mounted on said base member and including right and left side drag probes correlated to the right and left side edges of said base member and selectively displaceable between a retracted position in which said drag probes do not project below the running surface of the ski on which said base member is mounted to an extended position in which said drag probes do project below the running surface of the ski on which said base member is mounted so that when said ski is in use in a downhill run said drag probes extend into the snow supporting the ski so as to impose both a drag force and a rotational torque on said ski so that the drag force and torque may be separately controlled by the skier through execution of natural and conventional body movements; and c) drag probe assembly actuation means mounted on the base member operatively connected to said drag probe assembly and selectively actuable by a skier to shift said drag probes between retracted and extended positions;

d) said base member being provided with an aft end edge and a front end edge intercepting said right and left side edges, a first transverse bore extending through said base member between said right and left side edges adjacent said aft end edge, a second transverse bore extending through said base member between said right and left side edges adjacent said front end edge, a third transverse bore parallel to said first and second transverse bores extending through said base member between said right and left side edges intermediate said first and second transverse bores, said drag probe assembly being selectively rotatably mounted in said first transverse bore, said drag probe assembly actuation means being actuably mounted in said second transverse bore, and means mounted in said third transverse bore operatively interposed between said drag probe assembly and said drag probe assembly actuation means and operable to resiliently retain said drag probes in a selected position.

8. The universal integral ski control system according to claim 7, in which said means mounted in said third transverse bore operatively interposed between said drag probe assembly and said drag probe assembly actuation means and operable to resiliently retain said drag probes in a selected position comprises at least one spring-pressed detent ball assembly, said spring-pressed detent ball assembly cooperatively related with a force transmitting member mounted on the base member and extending longitudinally thereof and connected to said drag probe assembly actuation means and said drag probe assembly and including a detent block having detent recesses therein to selectively receive said spring-pressed detent balls.

9. As an article of manufacture, a universal integral ski control system for application to the skier support surface of a downhill snow ski having a "running" surface adapted to slide over the snow in a downhill run, comprising:

a) a base member adapted to be mounted on the skier support surface of a downhill snow ski and having right and left side edges correlated to the right and left edges of the downhill snow ski when mounted thereon;

b) a drag probe assembly operatively mounted on said base member and including right and left side drag probes correlated to the right and left side edges of said base member and selectively displaceable between a retracted position in which said drag probes do not project below the running surface of the ski on which said base member is mounted to an extended position in which said drag probes do project below the running surface of the ski on which said base member is mounted so that when said ski is in use in a downhill run said drag probes extent into the snow supporting the ski so as to impose both a drag force and a rotational torque on said ski so that the drag force and torque may be separately controlled by the skier through execution of natural and conventional body movements; and c) drag probe assembly actuation mans mounted on the base member operatively connected to said drag probe assembly and selectively actuable by a skier to shift said drag probes between retracted and extended positions;

d) said base member being provided with an aft and edge and a front edge, said drag probe assembly is mounted on said base member adjacent said aft end edge, said drag probe assembly actuation means includes an actuator shaft mounted on said base member adjacent said front end edge, and means operatively interconnecting said drag probe assembly actuation means with said drag probe assembly so that selective actuation of said actuator shaft by a skier effects selective displacement of said drag probes between retracted and extended positions; and e) said means interconnecting said drag probe assembly and said drag probe assembly actuation means comprising a force transmitting member including a detent block slidably mounted on the base member in response to actuation of said drag probe assembly or said drag probe assembly actuation means, and resiliently biased detent means mounted on said base member cooperating with said detent block to resiliently retain said detent block in a position corresponding to a selected position of said drag probes.

10. The universal integral ski control system according to claim 9, in which said force transmitting member includes an endless cable the lower reach of which intermediate said drag probe assembly and said drag probe assembly actuation means is connected to said detent block so that rotation of either of said drag probe assembly or said drag probe assembly actuation means effects longitudinal translation of said detent block.

11. The universal integral ski control system to claim 9, in which means are provided mounted on said base member operatively associated with said detent block and manipulable to vary the extent to movement of said detent block in one direction.

12. The universal integral ski control system according to claim 10, in which means are provided mounted on said base member operatively associated with said detent block and manipulable to vary the extent of movement of said detent block in one direction.

13. In combination, a universal integral ski control system and a ski boot including a sole structure adapted to be releasably engaged by downhill bindings including a toe piece to the support surface of a downhill snow ski having a "running" surface adapted to slide over the snow in a downhill run, said universal integral ski control system including a member forming a part of said sole structure, a drag probe assembly mounted on the base member and including at least one drag probe selectively movable from a resiliently retained retracted position substantially parallel with the sole of said ski boot to a resiliently retained extended position substantially perpendicular to said running surface and the sole of said ski boot, and a drag probe assembly actuation means mounted on said base member and selectively actuable to effect displacement of said drag probe between retracted or extended positions, said universal integral ski control system being integrally mounted on said ski boot in association with said sole structure so that said drag probe assembly is associated with the center of pressure of the ski when a skier wearing the ski boot locks the ski boot to said toe piece on the ski, whereby the skier is enabled through execution of conventional body movements to impart auxiliary control forces on said ski when it moves in relation to the snow to provide enhanced control over drag and enhanced maneuverability by the selective imposition of a rotational moment on each ski about the center of pressure thereof.

14. As an article of manufacture, a universal integral ski control system for application to the skier support surface of a downhill snow ski having a "running" surface adapted to slide over the snow in a downhill run, comprising:

a) a based member adapted to be mounted on the skier support surface of a downhill snow ski and having right and left side edges correlated to the right and left side edges of the downhill snow ski when mounted thereon;

b) a drag probe assembly operatively mounted on said base member and including right and left side drag probes correlated to the right and left side edges of said base member and selectively displaceable between a retracted position in which said drag probes do not project below the running surface of the ski on which said base member is mounted to an extended position in which said drag probes do project below the running surface of the ski on which said base member is mounted so that when said ski is in use in a downhill run said drag probes extend into the snow supporting the ski so as to impose both a drag force and a rotational torque on said ski so that the drag force and torque may be separately controlled by the skier through execution of natural and conventional body movements; and c) drag probe assembly actuation means mounted on the base member operatively connected to said drag probe assembly and selectively actuable by a skier to shift said drag probes between retracted and extended positions;

d) means interconnecting said drag probe assembly with said drag probe assembly and said drag probe assembly actuation means so that actuation of said drag probe assembly actuation means results in actuation of said drag prove assembly to displace said drag probes into either a retracted position or an extended position;

e) said means interconnecting said drag probe assembly with said drag probe assembly actuation means comprising an elongated force transmitting member mounted on the base member and connected between said drag probe assembly and said drag probe assembly actuation means so that rotation of either one effects longitudinal displacement of said force transmitting member and rotation of the other.

15. As an article of manufacture, a universal integral ski control system for application to the skier support surface of a downhill snow ski having a "running" surface adapted to slide over the snow in a downhill run, comprising:

a) a base member adapted to be mounted on the skier support surface of a downhill snow ski and having right and left side edges correlated to the right and left side edges of the downhill snow ski when mounted thereon;

b) a drag probe assembly operatively mounted on said base member and including right and left side drag probes correlated to the right and left side edges of said base member and selectively displaceable between a retracted position in which said drag probes do not project below the running surface of the ski on which said base member is mounted to an extended position in which said drag probes do project below the running surface of the ski on which said base member is mounted so that when said ski is in use in a downhill run said drag probes extend into the snow supporting the ski so as to impose both a drag force and a rotational torque on said ski so that the drag force and torque may be separately controlled by the skier through execution of natural and conventional body movements; and c) drag probe assembly actuation means mounted on the base member operatively connected to said drag probe assembly and selectively actuable by a skier to shift said drag probes between retracted and extended positions;

d) said base member being provided with an aft end edge and a front end edge, said drag probe assembly is mounted on said base member adjacent said aft end edge, said drag probe assembly actuation means includes an actuator shaft mounted on said base member adjacent said front end edge, and means operatively interconnecting said drag probe assembly actuation means with said drag probe assembly so that selective actuation of said actuator shaft by a skier effects selective displacement of said drag probes between retracted and extended positions;

e) said means operatively interconnecting said drag probe assembly actuation means with said drag probe assembly including a force transmitting member mounted on the base member and extending longitudinally thereof and connected to said drag probe assembly actuation means and said drag probe assembly in a manner so that actuation of either the drag probe assembly or the drag probe assembly actuation means effects actuation of the other; and f) said force transmitting member comprising a pair of mutually reaching longitudinally displaceable shafts extending longitudinally of the base member and having their associated ends interconnected and their remote ends translatably connected to said drag probe assembly on the one hand and said drag probe assembly actuation means on the other hand so that rotation of either one effects longitudinal translation of said pair of interconnected mutually reaching shafts.

16. In combination, a universal integral ski control system and a downhill ski having downhill ski boots bindings including a toe piece whereby ski control forces may be applied to a ski directly through said downhill ski boot bindings including said toe piece, said universal integral ski control system including a base member mounted on said ski and connected in cooperative association with said toe piece, a drag probe assembly mounted on the base member laterally adjacent said toe piece in the region of the center of pressure of said ski and including a pair of spaced control surfaces deployable from a resiliently retained retracted position into an extended resiliently retained active position through momentary use of a ski pole so as to set the probe to penetrate and be resiliently retained in the snow to thereby enable the skier through execution of conventional body movements to impart auxiliary control forces on the ski in relation to the snow to provide enhanced control over drag and enhanced maneuverability of the ski by imposition of a rotational moment thereon about the center of pressure thereof, and a drag probe assembly actuation means mounted on the base member and selectively manipulable through use of said ski pole to actuate said drag probe assembly.

17. The combination according to claim 16, wherein said probe assembly is provided on said universal integral ski control system as as integral part of said toe piece, and means are provided enabling shifting of the probe assembly axially from a first selected position to a second selected position.

18. The combination according to claim 16, wherein said probe assembly is provided on said universal integral ski control system mounted sandwiched between said toe piece and said downhill ski, and means are provided enabling shifting said probe assembly axially from a first selected position to a second selected position.

19. The combination according to claim 16, wherein said probe assemblies are provided on said universal integral ski control system integrally mounted in said ski, and means are provided enabling shifting said probe assembly axially from a first selected position to a second selected position.

20. The combination according to claim 16, wherein said universal integral ski control system is integrally mounted on said downhill ski boot.

* * * * *